US007588420B2

(12) United States Patent
Wang

(10) Patent No.: US 7,588,420 B2
(45) Date of Patent: Sep. 15, 2009

(54) CUSTOMIZED FAN BLADE AND METHOD OF MAKING SAME

(75) Inventor: Cliff Wang, Taichung (TW)

(73) Assignee: Air Cool Industrial Co., Ltd., Taichung (TW)

( * ) Notice: Subject to any disclaimer, the term of this patent is extended or adjusted under 35 U.S.C. 154(b) by 958 days.

(21) Appl. No.: 11/143,387

(22) Filed: Jun. 2, 2005

(65) Prior Publication Data

US 2006/0275133 A1 Dec. 7, 2006

(51) Int. Cl.
*F04D 29/38* (2006.01)

(52) U.S. Cl. ..... 416/146 R; 416/230

(58) Field of Classification Search ..... 416/146 R, 416/210 R, 227 R, 227 A, 229 R, 230; D23/413, D23/377, 385

See application file for complete search history.

(56) References Cited

U.S. PATENT DOCUMENTS 4,529,139 A * 7/1985 Smith et al. ..... 242/437.3
4,690,850 A * 9/1987 Fezio ..... 428/105
5,591,006 A * 1/1997 DeMeo et al. ..... 416/62
6,695,585 B2 * 2/2004 Moody et al. ..... 416/210 R

* cited by examiner

*Primary Examiner*—Ninh H Nguyen
(74) *Attorney, Agent, or Firm*—Parsons & Goltry; Michael W. Goltry; Robert A. Parsons

(57) ABSTRACT

A customized fan blade for use in combination with a conventional fan includes a platen having a peripheral edge that is profiled to a predetermined contour. Strands overlay at least one of the sides of the platen. The strands include warp strands and interlaced woof strands in accordance with a desired pattern. The strands may be of various materials, such as osier or cordage. A coating may be applied to the fan blade for preservation or color enhancing.

23 Claims, 4 Drawing Sheets

CUSTOMIZED FAN BLADE AND METHOD OF MAKING SAME

BACKGROUND OF THE INVENTION

1. Field of the Invention

The present invention relates to fans.

More particularly, this invention relates to fans of the type commonly employed to circulate air.

In a further and more specific aspect, the instant invention concerns a fan blade which can be readily and easily customized to accommodate the aesthetic considerations of the user.

2. The Prior Art

Fans are commonly employed to circulate air within a residence, a restaurant, an office or other structure. Common place are fans that are mounted in a horizontal configuration and fans that are mounted in a vertical configuration. Horizontally mounted fans, commonly referred to as ceiling fans, are generally suspended from an overhead by a shaft or chain. Vertical fans, commonly referred to floor mounted fans, are generally carried upon a stanchion.

Regardless of the mounting configuration, fans, as will be readily recognized by those skilled in the art and by users, include a motor, a hub rotatably driven by the motor and a blade assembly carried by the hub. The typical blade assembly includes a blade iron secured to the hub and having a distal end which supports the proximal end of a fan blade. For this purpose the distal end of the blade iron includes a surface for receiving the proximal end of the fan blade there against. The distal end of the blade iron also includes an arrangement of threaded bores for receiving screws which extend through corresponding openings in the proximal end of the fan blade.

Fan blades are typically fabricated of rigid sheet material such as wood or metal. Such blades tend to be rather prosaic and without aesthetic value. More recently, the prior art has attempted to enhance fan blades. The enhanced fan blades frequently require an especially fabricated frame that is not within the normal scope of the art of fan blade fabrication. Other enhanced fan blades provided by the prior art require especially fabricated blade irons. In general, the enhanced blades touted by the prior art are complex and expensive to manufacture.

It would be highly advantageous, therefore, the remedy the foregoing and other deficiencies inherent in the prior art.

SUMMARY OF THE INVENTION

The above problems and others are at least partially solved and the above objects and others realized in a method of fabricating a fan blade which comprises first providing a platen including a first side having an outwardly directed surface, a second side having a surface outwardly directed in opposition to the surface of the first side and a peripheral edge conjoining the sides. The method continues with overlaying strands upon one of the first and second sides.

The fan blade described above is for use in combination with a conventional fan having a motor, a hub rotatably driven by the motor and a blade iron extending from the hub and having a distal end to which the fan blade can be secured.

In accordance with the principles of the instant invention, the method continues by profiling the peripheral edge of the platen to correspond with a predetermined contour. Next is configuring the proximal end of the platen for attachment to the distal end of the blade iron. This is followed by forming openings in the proximal end of the platen to align with attachment openings in the distal end of the blade iron.

A further, in accordance with the principles of this invention, is dividing the strands into warp strands and woof strands. This is followed by interlacing the woof strands with the warp strands in accordance with a predetermined pattern. Extending the warp strands longitudinal of the platen or, alternately, extending the warp strands lateral of the platen are within the purview of the invention.

Within the scope of the present invention is encircling the strands over the peripheral edge onto the surface of the other of the first and second sides of the platen. Applying a coating to the strands is accomplished after the strands are placed upon one or more surfaces of the platen as desired. Fabricating the strands of cordage or, alternately, of osier is also within the teachings of this invention.

The fan blade constructed in accordance with the foregoing method includes a platen having a first side, a second side, a peripheral edge conjoining the sides and a proximal end adapted for attachment to the distal end of a blade iron. A plurality of strands is carried by the platen in juxtaposition with at least one of the first and second sides. The strands include a plurality of warp strands overlying at least one of the first and second sides of the platen and a plurality of woof strands interlaced with the warp strands in accordance with a predetermined pattern.

In accordance with the principles of the present invention, the strands encircle the peripheral edge to be received in juxtaposition with the other of the first and second sides of the platen. The warp strands extend longitudinally of the platen. Alternately, the warp strands extend laterally of the platen.

Further, in accordance with the principles of the instant invention, the peripheral edge of the platen is profiled to a predetermined pattern. The strands are fabricated of osier or, alternately, of cordage.

BRIEF DESCRIPTION OF THE DRAWINGS

The foregoing, and further and more specific objects and advantages of the instant invention, will become readily apparent to those skilled in the art from the following detailed description of preferred embodiments thereof, taken in conjunction with the drawings, in which.

DETAILED DESCRIPTION OF A PREFERRED EMBODIMENT

Figures 1, 2, 3:
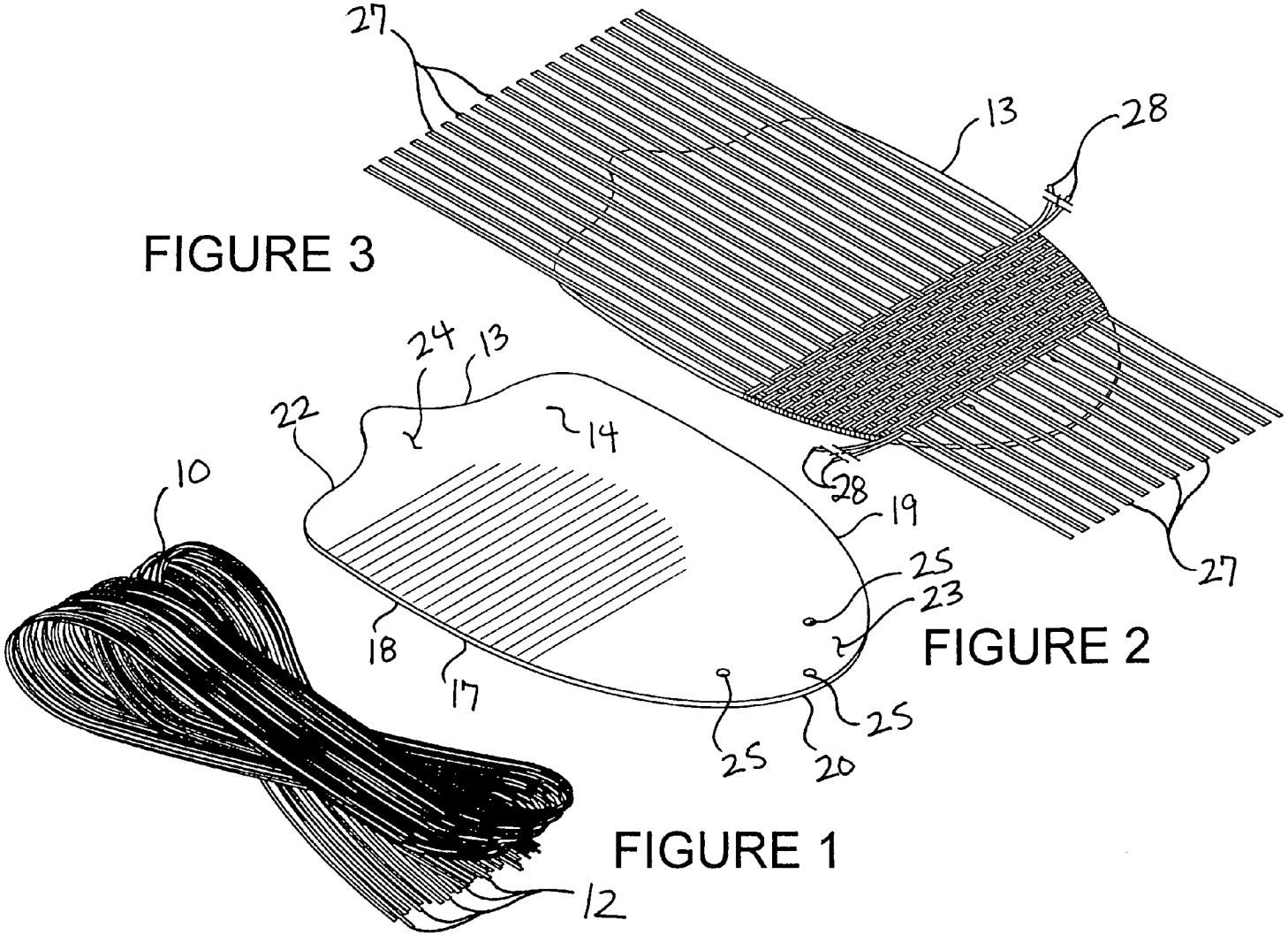
FIG. 1 is a perspective view of a skein of strands useful in connection with the instant invention.
FIG. 2 is a perspective view of a platen used in connection with the present invention.
FIG. 3 is a perspective view of the platen and the strands as would appear during an initial stage of fabricating a fan blade in accordance with a method of the invention.

Turning now to the drawings in which like reference characters indicate corresponding element through out the several views, attention is first directed to FIG. 1 is which is seen a skein 10 of strands 12. Strands 12 may be of various materials. It is within the scope of the instant invention that strands 12 may be fabricated of osier, as exemplified by pliable twigs, willows, dogwood and bamboo. It is also within the teachings of this invention that strands 12 be fabricated of cordage. Exemplary is natural cordage, such as cotton and wool, and synthetic cordage, such as nylon and rayon.

Referring now to FIG. 2, there is seen a platen 13. With momentary reference to FIG. 6 and FIG. 7, it is seen that platen 13 includes first side surface 14 and second side surface 15. The side surfaces 14 and 15 face outwardly in mutually opposing directions. Peripheral edge 17 extends about platen 13 and conjoins first side surface 14 and second side surface 15 and includes first longitudinal edge 18, second longitudinal edge 19, inner lateral edge 20 and outer lateral edge 22. Platen 13 is further defined as having a proximal end 23 and a distal end 24. Platen 13 may be fabricated of any rigid sheet material, such as wood, metal or composition.

An arrangement of openings 25 extend through platen 13 proximate proximal end 23. As will be readily appreciated by those skilled in the art, a conventional fan includes a motor, a hub rotatably driven by the motor and several blade irons extending radially outward from the hub and terminating with a distal end. The distal end includes a receiving surface for receiving the proximal of a fan blade there against. The distal end of the blade iron also includes an arrangement of openings, such as threaded bores for receiving screws which secure the proximal end of the fan blade to the distal end of the blade iron. Openings 25 in platen 13 are sized and arranged to coincide with the attachment openings in the distal end of a conventional blade iron.

The contour of peripheral edge 17 of platen 13, as seen in FIG. 3, was chosen herein for purposes of illustration. It is within the scope of the present invention that peripheral edge 17 can be profiled to a contour consistent with the aesthetic considerations of the user or owner.

Strands 12, as viewed with reference to FIG. 3, are divided into warp strands 27 and woof strands 28. Warp strands 27 are placed in juxtaposition with first side surface 14, or alternately with second side surface 15, of platen 13. Woof strands 28 are then interlaced with warp strands 27. The interlacing can be conventional weaving or in accordance with a predetermined pattern consistent with the desires of the owner or user. For purposes of illustration, warp strands 27 extend longitudinal of platen 13 and woof strands 28 extend lateral of platen 13. Consistent with the teachings of the present invention, warp strands 27 may extend lateral of platen 13 and woof strands 28 extend longitudinal of platen 13. It is also within the purview of this invention that warp strands 27 and woof strands 28 be placed diagonally of platen 13.

Figures 4, 5:
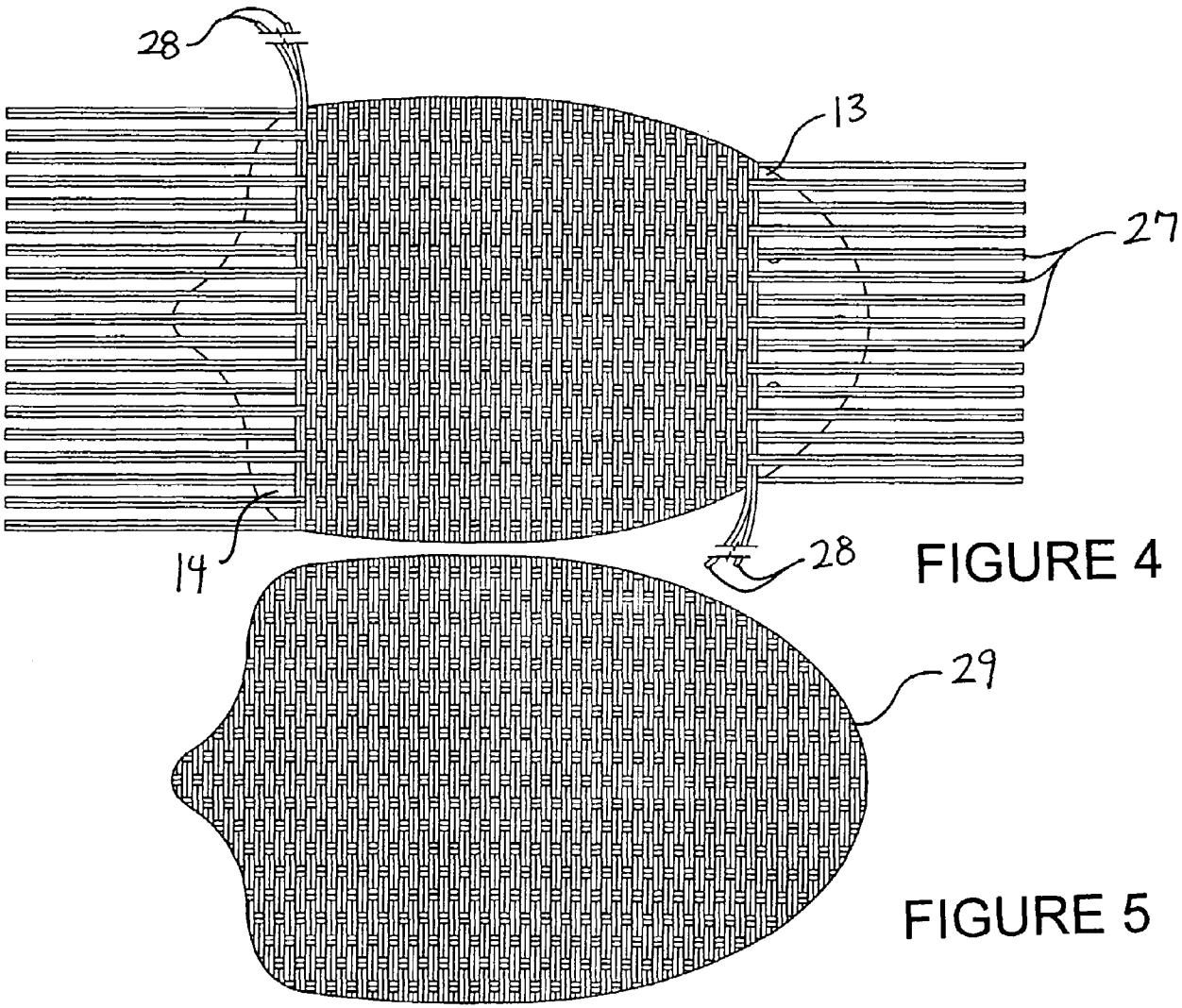
FIG. 4 is a plan view showing the fan blade of FIG. 3 as it would appear during an intermediate step of fabrication in accordance with a method of the instant invention.
FIG. 5 is a plan view of the fan blade of FIG. 4, is it would appear during a subsequent intermediate stage of fabrication.
Figures 6, 7:
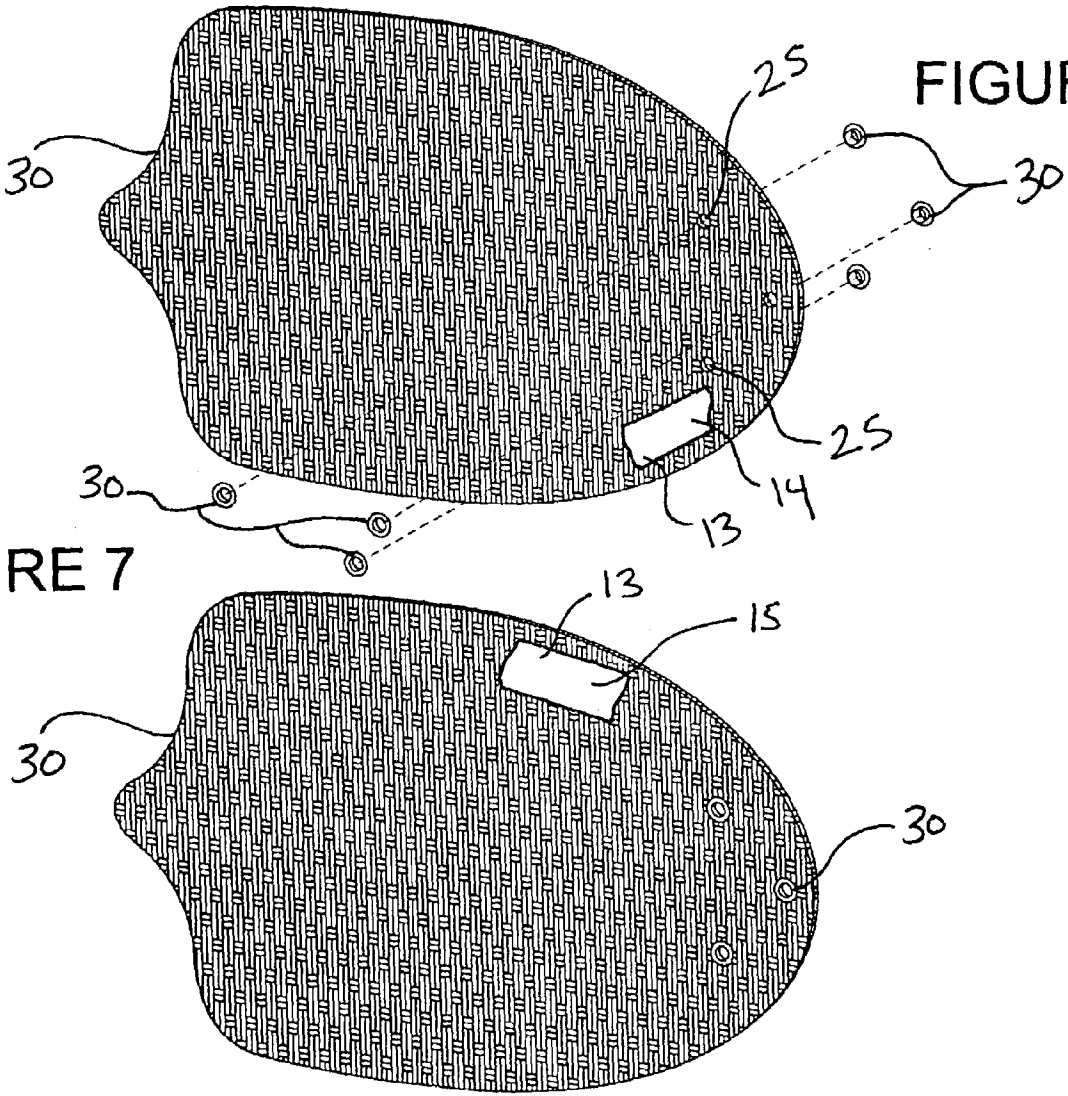
FIG. 6 is a perspective of the fan blade of FIG. 5 as it would appear during a final stage of the method of fabrication of the present invention.
FIG. 7 is a perspective view of the reverse side of the fan blade seen in FIG. 6.

The interlacing or weaving of woof strands 28 with warp strands 27 continues, as seen in FIG. 4, until the entire side surface 14 is covered to provide a customized fan blade 29 as viewed in FIG. 5. Consistent with the principles of the instant invention, the interlaced warp strands 27 and woof strands 28 may cover one surface of platen 13 or, alternately, encircle the peripheral edge 17 and continue to be interlaced over the other side surface of platen 13 to provide an alternate customized fan blade 30 as illustrated in FIG. 6 and FIG. 7. If the interlaced warp strands 27 and woof strands 28 are confined to only one side of platen 13, an adhesive is required to bond the strands to the respective side.

Attention is now directed to FIG. 6, in which it is seen that openings 25 are extended through the several strands 12. Such extension may sever the strands. To prevent the severed strands from raveling, a ferrule or grommet 30 is inserted into each side of each opening 25 with the flange thereof captivating the loose ends of the severed strands.

Figure 8:
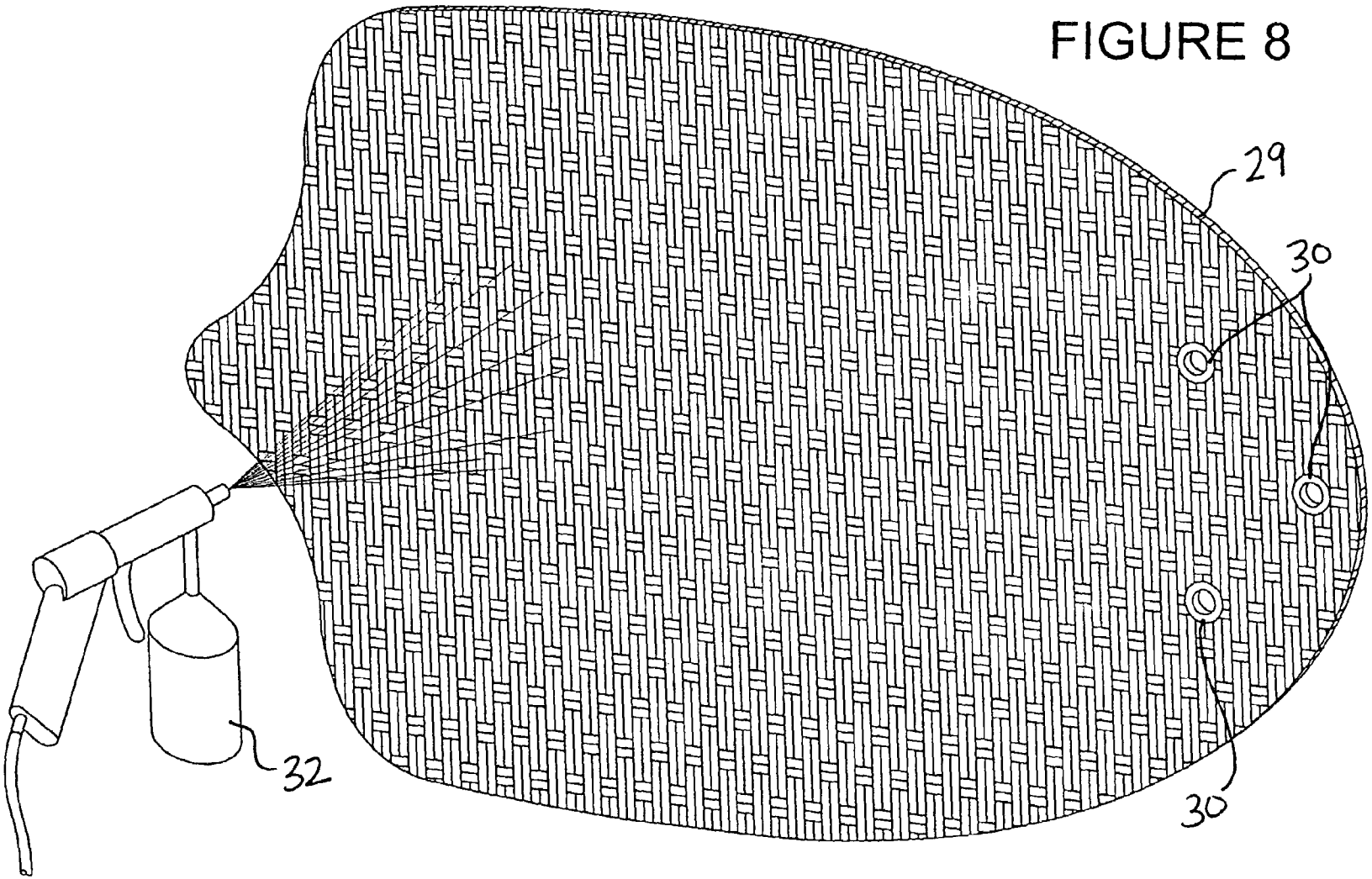
FIG. 8 is perspective view of a fan blade seen during an optional final step in the method of this invention.

If desired, as illustrated by spray gun 32 in FIG. 8, a finish may be applied to the customized fan blade 29. The finish may be for preservation purposes, such as lacquer, or for color enhancing as by paint.

The present invention is described above with reference to a preferred embodiment. However, those skilled in the art will recognize that changes and modifications may be made in the described embodiment without departing from the nature and scope of the present invention. For example, while the preferred embodiment utilized a custom made platen, it is within the purview of the invention that the surface treatment and customizing features can be applied to a conventional, commercially available fan blade. Also, the woof strands can be interlaced with the warp strands in patterns other than those illustrated.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A method of fabricating a fan blade for use in combination with a fan, which fan includes a motor, a hub rotatably driven by said motor and a blade iron extending from said hub and having a distal end, said method comprising the steps of:

providing a platen including a first side having an outwardly directed surface, a second side having a surface directed outwardly in opposition to the surface of the first side and a peripheral edge conjoining the first side and the second side; and overlaying strands upon the surface of at least one of the first and the second sides;

wherein said platen includes a proximal end and said step of providing includes configuring the proximal end of said platen for attachment to the distal end of said blade iron.

2. The method of claim 1, wherein the step of providing a platen includes the substep of profiling the peripheral edge of said platen to a predetermined contour.

3. The method of claim 1, further including the step of forming openings in the proximal end of said platen to align with attachment openings in the distal end of said blade iron.

4. The method of claim 1, wherein the step of overlaying strands includes the step of dividing said strands into warp strands and woof strands.

5. The method of claim 4, further including the step of interlacing said woof strands with said warp strands.

6. The method of claim 5, further including the step of extending said warp strands longitudinal of said platen.

7. The method of claim 5, further including the step of extending said warp strands lateral of said platen.

8. The method of claim 5, further including the step of interlacing said woof strands with said warp strands in accordance with a predetermined pattern.

9. A fan blade constructed in accordance with the method of claim 8.

10. The method of claim 1, wherein the step of overlaying strands further includes the substep of encircling said strands over the peripheral edge and onto the surface of the other of the first side and second side of said platen.

11. The method of claim 1, including the further step of applying a coating to said strands.

12. The method of claim 1, including the step of fabricating said strands of cordage.

13. The method of claim 1, including the step of fabricating said strands of osier.

14. A fan blade constructed in accordance with the method of claim 1.

15. A fan blade for use in combination with a fan having a motor, a hub rotatably driven by said motor and a blade iron extending from said hub and having a distal end, said fan blade comprising:

a platen having a first side, a second side, a peripheral edge conjoining said sides and a proximal end adapted for attachment to the distal end of said blade iron; and a plurality of strands carried by said platen in juxtaposition with at least one of said first and second sides.

16. The fan blade of claim 15, wherein said strands include:

a plurality of warp strands overlaying at least one of the first and second sides of said platen; and a plurality of woof strands interlaced with said warp strands in accordance with a predetermined pattern.

17. The fan blade of claim 16, wherein said strands encircle said peripheral edge to be received in juxtaposition with the other of the first and second sides of said platen.

18. The fan blade of claim 16, wherein said warp strands extend longitudinally of said platen.

19. The fan blade of claim 16, wherein said warp strands extend laterally of said platen.

20. The fan blade of claim 15, wherein the peripheral edge of said platen is profiled to a predetermined contour.

21. The fan blade of claim 15, wherein said strands are fabricated of osier.

22. The fan blade of claim 15, wherein said strands are fabricated of cordage.

23. The fan blade of claim 15, further including protective coating overlying said strands.

* * * * *